United States Patent [19]

Tokuno

[11] Patent Number: 4,569,714

[45] Date of Patent: Feb. 11, 1986

[54] SINGLE FACER HAVING RAPID ROLL CHANGING MEANS

[75] Inventor: Masateru Tokuno, Nishinomiya, Japan

[73] Assignee: Rengo Co., Ltd., Osaka, Japan

[21] Appl. No.: 286,537

[22] Filed: Jul. 24, 1981

[30] Foreign Application Priority Data

Aug. 1, 1980 [JP] Japan ..... 55-106672
Jul. 2, 1981 [JP] Japan ..... 56-103932

[51] Int. Cl.[4] ..... B31F 1/24

[52] U.S. Cl. ..... 156/471; 156/474; 156/578; 118/262; 425/363; 425/369

[58] Field of Search ..... 156/470, 471, 472, 473, 156/578; 425/363, 369; 101/152, 153, 216, 23; 118/262

[56] References Cited

U.S. PATENT DOCUMENTS

| | | | |
|---|---|---|---|
| 2,129,699 | 9/1938 | Luehrs | 101/152 |
| 2,380,322 | 7/1945 | Marquardt | 118/262 |
| 2,589,966 | 3/1952 | Rullo | 156/472 |
| 3,390,040 | 6/1968 | Moser et al. | 156/473 |
| 3,455,767 | 7/1969 | Meister | 156/473 |
| 3,783,782 | 1/1974 | Hardt | 101/216 |
| 3,789,757 | 2/1974 | Motter et al. | 101/153 |
| 4,021,179 | 5/1977 | Pira | 425/369 |
| 4,038,130 | 7/1977 | Cosby | 156/473 |
| 4,177,102 | 12/1979 | Tokuno | 156/472 |
| 4,527,638 | 9/1970 | Sonnichsen | 156/470 |

*Primary Examiner*—Jerome Massie
*Attorney, Agent, or Firm*—Harding, Earley, Follmer & Frailey

[57] ABSTRACT

A single facer for manufacturing single-faced corrugated boards comprising a pair of side frames, each side frame having an interior opening which has been formed so that either or both of upper and lower corrugating rolls may be lowered and taken out through it.

11 Claims, 1 Drawing Figure

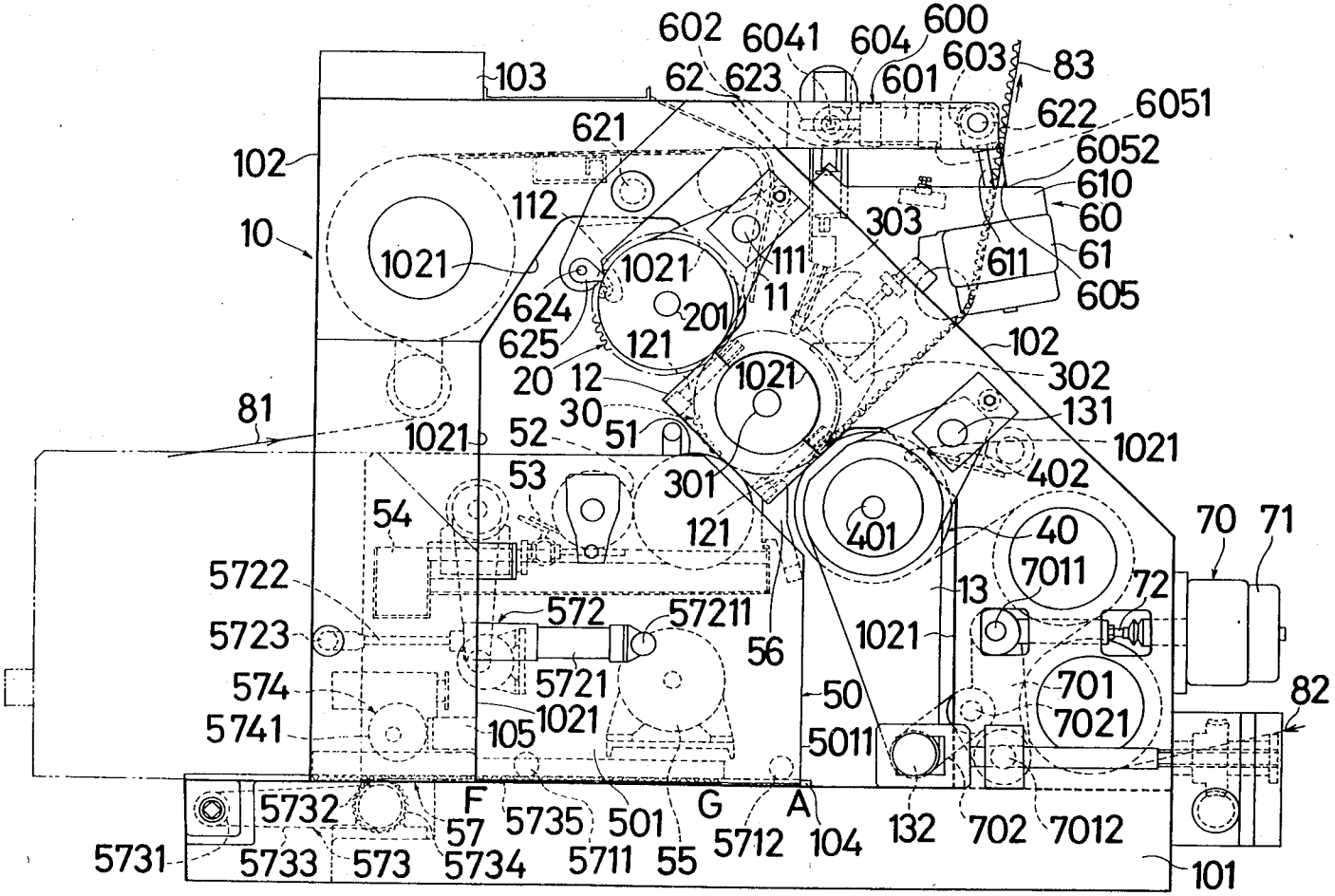
600
601
602
603
604
6041
6051
6052
605
60
61
610
611
62
621
622
623
624
625
83
102
103
10
81
111
11
112
20
201
121
12
30
301
302
303
401
402
40
131
13
1021
50
5011
51
52
53
54
56
57
5711
5712
5721
5722
5723
5731
5732
5733
5734
5735
572
573
574
5741
55
501
5211
701
7011
7021
7012
702
132
104
105
101
70
71
72
82
A
F
G

SINGLE FACER HAVING RAPID ROLL CHANGING MEANS

The present invention relates to a single facer for manufacturing single-faced corrugated boards, and more particularly to a single facer either or both of whose upper and lower corrugating rolls can be rapidly replaced.

The inventor previously invented a single facer as described in U.S. Pat. No. 4,177,102. The single facer has been provided with a lower corrugating roll which has a plurality of grooves formed around the periphery of the roll and having a plurality of suction apertures formed through the base of the grooves, and which retain a medium liner firmly on the roll by means of the suction in the grooves. Consequently, it has been enabled to manufacture high quality single-faced corrugated boards efficiently at high speed.

The single facer according to the former invention has been provided with doctor-plates engaging within the grooves in an upper portion of the lower corrugating roll not coming in contact with the medium liner, for the purpose of cleaning the grooves, preventing the medium liner from coiling around the lower corrugating roll and improving the efficiency of sucking the suction. Further, as described in the Japanese Official Gazette for published patent application No. 53-119189, a flushing nozzle, which is capable of emitting steam in order to prevent the apertures from clogging, has been provided above the lower corrugating roll. Also recently, the single facer has been totally covered by means of sound insulating and absorbing materials for the purpose of preventing noise.

Because of the above-mentioned and owing to the condition that air-cylinders, levers, steam pipings, paper rolls, moisteners and so on are arranged above the frame of the single facer, when work for lifting and replacing the upper and lower corrugating rolls and the pressure roll is respectively carried out, it takes more than a day to remove and reassemble the before-mentioned equipment arranged above the respective rolls. Accordingly, the operation of the single facer had to be stopped for a long time.

It is an object of the present invention to provide a single facer, wherein replacement of either or both of an upper corrugating roll and a lower corrugating roll can be done in an extremely short time.

Other objects of the present invention will be apparent from following detailed description and an annexed drawing.

A preferred embodiment of the single facer according to the present invention will be described in conjunction with the drawing.

The drawing shows a side view of the preferred embodiment of the single facer.

A frame 10 comprises a base 101, a pair of transverselly spaced side frames 102, which are in the general shape of an inverted "U" and stand vertically on the base 101, and a stay 103 horizontally bridging the space between the pair of side frames and strengthening the pair of side frames. Each side frame 102 is provided with an interior opening 1021.

As to the rotatable upper corrugating roll 20, both journals 201 of its shaft are supported on the pair of side frames 102 by means of a pair of hanging or dependent brackets 11, in which bearings (not shown) are assembled, so that the journals may be held respectively in the openings 1021. Each hanging bracket 11 is pivotably mounted on the side frame 102 by means of a pin 111, and is connected via a fixed pin 112 to a hook 625, which is pivotably supported on a pin 624 at the lower end of one of a pair of transversely spaced levers 62 to be after-mentioned.

A rotatable lower corrugating roll 30 meshes with the upper corrugating roll 20. Both journals 301 of its shaft are supported on the pair of side frames 102 by means of a pair of dependent fixing brackets 12, in which bearings (not shown) are assembled, so that the journals may be held respectively in the openings 1021. The fixing brackets 12 are releasably fixed on the pair of side frames 102 by means of bolts 121. The lower corrugating roll 30 has the same construction as the one described in the before-mentioned U.S. Pat. No. 4,177,102, and doctor-plates 302 are inserted into grooves (not shown), which are formed around the periphery of the roll. Further, flushing nozzles are arranged near the periphery of the roll so that they may move parallel to the axial direction of the roll, for the purpose of preventing apertures (not shown) from clogging, said apertures being formed through the bases of the grooves.

A rotatable pressure roll 40 comes in contact with the lower corrugating roll 30. Both journals 401 of its shaft are supported on the pair of side frames 102 by means of a pair of hanging or dependent brackets 13, in which bearings (not shown) are assembled, so that the journals may be held respectively in the openings 1021. As to the hanging bracket 13, one end of the bracket is pivotably mounted on the side frame 102 by means of a pin 131, while the other end of the bracket is pivotably connected with the front end of a link 702 to be aftermentioned by means of a pin 132. Also, on the periphery of the pressure roll 40 is provided a doctor-plate 402 which comes in contact with the roll to remove dust from the periphery.

A pressure device 60 is a device for urging the upper corrugating roll 20 against the lower corrugating roll 30, and comprises the pair of levers 62 and a pair of diaphragm-cylinders 61. The pair of levers 62 are respectively mounted on the pair of side frames 102, each having a pin 621 as a fulcrum. Each circular shaped lower or inner end of the pair of levers 62 is located at a position where the end comes in contact with a circular portion of the hanging bracket 11, and is connected to the brackets hook by means of the hooks 625, as mentioned before. The pair of diaphragm-cylinders 62 are respectively mounted on the pair of side frames 102 by means of a pair of stands 610, and the top end of each rod 611 is pivotably connected with the upper end of the lever 62 by means of a pin 622.

A lifting device 600 is a device which is adapted to disengage the upper corrugating roll 20 from the lower corrugating roll 30 when the operation of the single facer is suspended. Lifting device 600 raises the upper corrugating roll 20 to separate the upper corrugating roll 20 from the lower corrugating roll 30. The lifting device 600 comprises a pair of spaced cylinders 601 mounted on the levers 62, a pair of sprockets 604 rotatably mounted on shafts 6041 which are slidably engaged in elongated slots 623 in the levers 62 and connected to the outer ends of piston rods 602 of the cylinders 601, a pair of sprockets 603 rotatably supported on the levers 62 by means of pins 622, and a pair of chains 605 extending respectively from one ends 6051 fixed on the cylinders 601 to the other ends 6052 fixed on the stands 610 via the sprockets 604 and 603.

Another pressure device 70 is a device for pressing the pressure roll 40, and comprises a pair of diaphragm-cylinders 71, a pair of levers 701 and a pair of links 702. The pair of diaphragm-cylinders 71 are respectively mounted on the pair of side frames 102, and the outer end of each rod 72 is pivotably connected to the lever 701 by means of a pin 7011. The pair of levers 701 are arranged so that each lever may have a pin 7012, which is respectively fixed on the pair of side frames 102, as a pivoting axis. As to the pair of links 702, one end of the link is pivotably connected to the lever 701 by means of a pin 7021, while the other end of the link is pivotably connected to the bracket 13 by means of the pin 132, as described before.

A device 50 for applying adhesive is accommodated in a box-like frame 501, which is separated from the frame 10. Rollers 5711 and rollers 5712 are rotatably mounted on each side of the frame 501 adjacent its bottom, and the pairs of rollers 5711 and 5712 are positioned on a pair of spaced guide rails 104, so that the device 50 may be moved by a moving device 57 to be mentioned after hereinafter. In the frame 501, various equipment such as an adhesive roll 51, a doctor roll 52, a doctor knife 53, an adhesive pan 54, a driving device 55 for the adhesive roll 51 and the doctor roll 52, a water jacket 56 and so on are accommodated for applying adhesive onto the peaks of flutes of a medium liner 81, which winds round about the lower corrugating roll 30. The driving device 55 is a separate driving device from the driving device (not shown), which is mounted on the frame 10 for driving the lower corrugating roll 30.

The moving device 57 for the adhesive applying device 50 comprises a pair of air-cylinder means 572, rack-pinion means 573 and an adjustment means 574. The air-cylinder means 572 are devices for moving the frame 501, in which the device 50 for applying adhesive is accommodated, by means of the pairs of rollers 5711 and 5712 so as to move rear end 5011 of the frame 501 from a position A to a position G. Each rear end of the pair of air-cylinders 5721 is mounted on a side of the frame 501 by means of a pin 57211, while each front end of the piston rods 5722 is connected to an inside-face of each side frame 102 by means of a pin 5723. The rack-pinion means 573 are devices for moving the frame 501 by means of the pairs of rollers 5711 and 5712, so that the end 5011 of the frame 501 is moved from the position G to a position F, which is out of the operating range of the air-cylinder means 572. Each rack-pinion means 573 comprises sprockets 5731 and 5732 rotatably mounted on the base 101, a chain 5733 wound around the sprockets and a pair of pinions 5734 fixed on a shaft (not shown) of the sprocket 5732. The pair of pinions 5734 are engaged with a pair of racks 5735, which are mounted on the base 101 at the both sides of the frame 501.

The adjustment means 574 are devices for adjusting the contact, i.e. the gap and parallelism, between the adhesive roll 51 and the lower corrugating roll 30. In the means 574, a pair of eccentrics 5741, which are fixed respectively to the opposite sides of the frame 501, are capable of coming in contact with a pair of stoppers 105, which are mounted on the insides of the pair of side frames 102 and also adapted to be optionally turned and fixed.

Further, the rack-pinion means 573 are unnecessary, if the stroke of the air-cylinder 572 is elongated so that the end 5011 of the frame 501, which accommodates the device 50 for applying adhesive, may be moved from the position A to the position F.

In the drawing, the reference character 83 indicates a single-faced corrugated board, which is composed of a medium liner 81 and a liner board 82.

Next, with regard to the replacement of the lower corrugating roll 30, the upper corrugating roll 20 and the pressure roll 40, as well as the movement of the device 50 for applying adhesive, explanation now will be given.

Steam valves (not shown) and drain valves (not shown) of the upper corrugating roll 20 and the pressure roll 40 are closed, and steam releasing valves (not shown) are opened, and then steam inside of the rolls is exhausted. When the operation of the single facer has been stopped, the device 50 for applying adhesive is moved by means of the air-cylinder means 572, so that the end 5011 of the frame 501 may be moved from the position A to the position G, which is at the limit of the range of the operation of the air-cylinder means 572.

The pins 5723 at the outer of the rods 5722 of the air-cylinders 572 are pulled out, and the sprocket 5731 of the rack-pinion means 573 is turned by hand. Then, the device 50 for applying adhesive is further moved so that the end 5011 of the frame 501 may be moved from the position G to the position F, in order to provide clearance between the spaced openings 1021 of the pair of side frames 102. Parts which are connected to the rolls, such as steam pipings (not shown) for the upper corrugating roll 20 and the pressure roll 40, a coupling (not shown) between the lower corrugating roll 30 and the driving means therefor (not shown), a suction pipe (not shown) for the lower corrugating roll 30 and so on, are disassembled.

Preparations are made for hanging the lower corrugating roll 30 by means of a rope. Air inside of the cylinders 61 of the pressure device 60 is exhausted, and the lifting devices 600 are operated. Then the rods 602 are advanced and the upper corrugating roll 20 is separated from the lower corrugating roll 30 by means of the levers 62. Air inside the pressure device 70 is exhausted and the pressure roll 40 is separated from the lower corrugating roll 30. The fixing brackets 12 for the lower corrugating roll 30 are removed from the side frames 102, and the lower corrugating roll 30 is lowered and taken out transversely through an opening 1021.

Preparations are made for hanging the upper corrugating roll 20 by means of a rope. After the upper corrugating roll 20 is hung and the hooks 625 are turned and removed from the fixed pins 112 of the hanging brackets 11, air inside of the cylinders 601 of the lifting device 600 is exhausted, and pins 111 of the hanging brackets 11 and pulled out in turn. Then, the upper corrugating roll 20 is lowered and taken out transversely through an opening 1021. After the pressure roll 40 is hung, pins 131 and 132 of the hanging brackets 13 are pulled out. Then the pressure roll 40 is lowered and taken out transversely through the opening 1021.

Another lower corrugating roll 30, another upper corrugating roll 20 and another pressure roll 40, which constitute the new replacement rolls, then will be supported respectively by the pairs of brackets 11, 12 or 13 in the manner previously described. The new rolls are respectively mounted in turn on the pairs of side frames 102 by means of the pair of brackets 11, 12 and 13, after the new rolls are respectively disposed at the positions from where the original rolls were removed. To the lower corrugating roll 30 the driving device, suction pipe and so on are connected. To the upper corrugating roll 20 and the pressure roll 40, the steam piping and so on are connected. Then, the steam releasing valves are closed and the steam valves and the drain valves are opened.

Subsequently, the shaft of the sprocket 5731 is turned by hand, and the device 50 for applying adhesive is advanced so as to move the end 5011 of the frame 501 from the position F to the position G. Then, each outer end of the rod 5722 of the air-cylinder 572 is fixed inside the side frames 102 by means of the pins 5723, and the air-cylinder means 572 are operated and device 50 is moved until the eccentrics 5741 come in contact with the stoppers 105 (position A). The eccentrics 5741 are turned whereby the degree of parallelism and the gap of the contract between the adhesive roll 51 and the lower corrugating roll 30 are adjusted and then the eccentrics 5741 are fixed. In this way the works are completed.

Although the upper corrugating roll 20 is removed after the lower corrugating roll 30 has been removed during before-mentioned work, the upper corrugating roll 20 can be removed without removal of the lower corrugating roll 30. Accordingly, further explanation will be given as to how the upper corrugating roll 20 is removed in advance of the removal of the lower corrugating roll 30. The hooks 625 on the inner ends of levers 62 are turned and removed from the fixed pins 112 of the hanging brackets 11. Air inside the air-cylinders 61 of the pressure device 60 is exhausted. The rods 602 of the lifting devices 600 on the outer ends of levers 62 are advanced and the lower ends of the levers 62 are lifted. Preparations are made for hanging the upper corrugating roll 20 by means of a rope. The pins 111 of the hanging brackets 11 are pulled out, and the upper corrugating roll 20 is lowered and taken out through an opening 1021.

In the single facer according to the present invention, each end of the shaft of both the upper and lower corrugating rolls is located inside each opening of the side frame respectively. Each opening has an area sufficient to permit the rolls to be taken out transversely through it. The device for applying adhesive is capable of being moved to a position in which the device does not interfere with works for replacing the rolls.

Accordingly, the arrangement for replacing either or both of the upper and lower corrugating rolls eliminates the need for removing and reassembling all the various devices, which have been arranged above the single facer, such as the flushing nozzles, steam pipings, covers for preventing noise, air-cylinders, levers, paper rolls, moisteners and so on.

Therefore, according to the present invention, either or both of the upper and lower corrugating rolls are easily replaced, and the time necessary to the replacement is substantially shortened, and this greatly contributes to the improvement of the productivity of single-faced corrugated boards. Further, if the upper and lower corrugating rolls are changed, the single facer can produce various single-faced corrugated boards, which have different flutes, in a short time. Furthermore, if two or more single facers according to the invention are used, it is possible to change and produce various double-wall corrugated boards and triple-wall corrugated boards in a short time.

What is claimed is:

1. A single facer for manufacturing single-faced corrugated board comprising a frame having a base supporting a pair of transversely spaced side frames between which are disposed an upper corrugating roll, a lower corrugating roll meshing with the upper corrugating roll, a pressure roll for contact with the lower corrugating roll and an adhesive applying device arranged near the lower corrugating roll, characterized by means permitting one or more of said rolls to be lowered and removed from the single facer and replaced by substitute rolls in a relatively short period of time, said means including (a) an interior opening formed within each side frame adjacent the base for removal of the corrugating and pressure rolls, (b) support means mounted on the side frames for releasably supporting the rolls adjacent the openings, said support means including releasing means operative to release said rolls to permit said rolls to be lowered for removal through the openings, (c) support means for movably supporting the adhesive applying device on the frame with capacity to enable the adhesive applying device to move toward or away from the lower corrugating roll and (d) actuating means connected to the adhesive applying device, said actuating means being operative to retract the adhesive applying device from the lower corrugating roll a distance sufficient to provide clearance adjacent the openings in the side frames to permit removal of the corrugating and pressure rolls.

2. A single facer as claimed in claim 1, wherein (a) the adhesive applying device includes a horizontally movable enclosure for containment of an adhesive applicator means, said adhesive applicator means including an adhesive roll and an adhesive pan, and (b) the support means for the adhesive applying device constitutes guide rails mounted on the base and rollers mounted on the enclosure and engageable with the guide rails.

3. A single facer as claimed in claim 2, wherein the actuating means is operative to advance the adhesive applying device toward the lower corrugating roll to dispose the adhesive roll in contact with the lower corrugating roll.

4. A single facer as claimed in claim 3, further including adjustment means for adjusting the contact between the adhesive roll and the lower corrugating roll, said adjustment means including (a) at least one eccentric mounted on the movable enclosure and (b) at least one stopper mounted on a side frame.

5. A single facer as claimed in claim 1, further including (a) upper corrugating roll support means comprising a pair of transversely spaced hanging brackets and pivot means releasably disposed in the side frames for mounting said hanging brackets pivotally, (b) a pair of transversely spaced levers mounted on the side frames, said levers each having an inner end and an outer end, (c) fulcrum means affixed to the side frames and connected to the levers intermediate their inner and outer ends, said fulcrum means providing pivots for mounting the levers pivotally relative to the side frames, (d) connection means connecting the inner ends of the levers to the hanging brackets and (e) lever actuating means connected to the outer ends of the levers and operative to pivot the levers about the fulcrum means to move the upper corrugating roll away from the lower corrugating roll preparatory to permitting said rolls to be lowered for removal through the opening.

6. A single facer as claimed in claim 5, wherein the connection means includes (a) pins affixed to each hanging bracket and (b) pivotal hooks mounted on the inner ends of the levers and connectable to said pins.

7. A single facer as claimed in claim 5, wherein the pivot means for the upper corrugating roll hanging brackets are removable to permit the upper corrugating roll to be lowered for removal.

8. A single facer as claimed in claim 1, wherein the lower corrugating roll support means comprises a pair of transversely spaced fixing brackets and connecting means releasably affixing said brackets to the side frames.

9. A single facer as claimed in claim 1, wherein (a) the pressure roll support means comprises a pair of transversely spaced hanging brackets and pivot means releasably disposed in the side frames for mounting said hanging brackets pivotally, (b) said pivot means being removable to permit the pressure roll to be lowered for removal, and (c) bracket actuating means supported by the frame and connected to said hanging brackets, said bracket actuating means being operative to pivot said brackets to advance the pressure roll to, or to retract the pressure roll from, the lower corrugating roll.

10. A single facer as claimed in claim 1, further including (a) a lifting device mounted on the frame and connected tot he upper corrugating roll, said lifting device being operative to move the upper corrugating roll away from the lower corrugating roll preparatory to permitting said rolls to be lowered for removal through the opening, and (b) dependent brackets for releasably supporting the corrugating and pressure rolls vertically relative to the openings, said brackets being operative to release selectively any one, or any two, or all three of the rolls, whereby said rolls may be lowered selectively for removal transversely through one of the openings.

11. A single facer for manufacturing single-faced corrugated board comprising a frame having a base supporting a pair of transversely spaced side frames between which are disposed an upper corrugating roll, a lower corrugating roll meshing with the upper corrugating roll, a pressure roll for contact with the lower corrugating roll and an adhesive applying device arranged near the lower corrugating roll, characterized by means permitting one or more of said rolls to be lowered and removed from the single facer and replaced by substitute rolls in a relatively short period of time, said means including (a) an interior opening formed within at least one side frame adjacent the base for removal of the corrugating and pressure rolls, (b) support means mounted on the side frames for releasably supporting the rolls adjacent the openings, said support means including releasing means operative to release said rolls to permit said rolls to be lowered for removal through the openings, and (c) support means for movably supporting the adhesive applying device on the frame with capacity to enable the adhesive applying device to move toward the lower corrugating roll or to move away from the lower corrugating roll a distance sufficient to provide clearance adjacent the side frame opening to permit removal of the corrugating and pressure rolls.

* * * * *